United States Patent [19]

Shutoh

[11] 4,028,584

[45] June 7, 1977

[54] DRIVING CIRCUIT FOR SELECTING CONTROL CELLS OF A GAS DISCHARGE PANEL BY TRANSISTORS THROUGH DIODES

[75] Inventor: Masamichi Shutoh, Tokyo, Japan

[73] Assignee: Nippon Electric Company, Ltd., Tokyo, Japan

[22] Filed: Sept. 17, 1975

[21] Appl. No.: 614,188

[30] Foreign Application Priority Data

Oct. 18, 1974 Japan ..... 49-120508

[52] U.S. Cl. ..... 315/169 TV; 315/169 R; 340/324 M

[51] Int. Cl.[2] ..... H05B 41/14; H01J 65/00

[58] Field of Search ..... 315/169 TV, 169 R; 340/166 EL, 173 PL, 324 M

[56] References Cited

UNITED STATES PATENTS

| | | | |
|---|---|---|---|
| 3,878,430 | 4/1975 | Hirose | 340/324 M X |
| 3,909,665 | 9/1975 | Andoh et al. | 315/169 TV |

*Primary Examiner*—Eugene R. LaRoche

[57] ABSTRACT

A driving circuit for a gas discharge panel comprises display cells between first and second electrodes and control cells between the first electrodes and third electrodes which are in one-to-one correspondence with the first electrodes. The circuit comprises a small number of diodes connected to each third electrode and transistors, fewer in number than the third electrodes, divided into a small number of subgroups. The diodes connected to each third electrode are connected to one of the transistors of the respective subgroups. The transistors connected to only one of the third electrodes are rendered nonconductive at any given time.

7 Claims, 3 Drawing Figures

DRIVING CIRCUIT FOR SELECTING CONTROL CELLS OF A GAS DISCHARGE PANEL BY TRANSISTORS THROUGH DIODES

BACKGROUND OF THE INVENTION

This invention relates to a driving circuit for a gas discharge panel having control cells.

In one type of gas discharge panel disclosed in U.S. patent application Ser. No. 555,139, now U.S. Pat. No. 3,976,971, filed by Tsunekiyo Iwakawa and Akira Yano, assignors to the present assignee, a set of first electrodes are disposed opposite to a set of second electrodes and to third electrodes which are in one-to-one correspondence with the first electrodes. Gas discharge spaces or cells for developing desired displays (herein named display cells) are defined between each of the second electrodes and at least one of the first electrodes. Gas discharge spaces or cells for performing the control function of selectively supplying an electric voltage to the first electrodes (herein called control cells) are formed between the first electrodes and the corresponding third electrodes.

To make the control cells carry out the control function, a driving circuit for a gas discharge panel of the type described comprises a circuit for selecting the control cells, one at a time. The selecting circuit in turn comprises, a switching element, such as a transistor, connected to each third electrode. Switching or control signals are selectively supplied to the switching elements to render the switching element connected to only one of the third electrodes off or nonconductive at a time while maintaining other switching elements on, or conductive.

When there are a large number of first electrodes, a similarly large number of switching elements have invariably been used, consequently giving rise to an expensive driving circuit. When coded signals are used to select the control cells, it has been necessary to resort to a decoder to derive the switching signals from the coded signals.

SUMMARY OF THE INVENTION:

It is therefore an object of the present invention to provide a driving circuit for a gas discharge panel of the type described, which comprises only a relatively small number of switching elements.

It is another object of this invention to provide a driving circuit of the type described and operable by coded switching signals without a decoder.

A driving circuit according to the present invention operates in conjunction with gas discharge panel comprising a set of first electrodes, a set of second electrodes opposite to the first electrodes, third electrodes opposite and in one-to-one correspondence to the first electrodes, display cells between each of the second electrodes and at least one of the first electrodes, and control cells between the first electrodes and the corresponding third electrodes. The driving circuit comprises a first plurality of first terminals for connection to the second electrodes; a second plurality of second terminals for connection to the third electrodes; a group of first switching elements, such as transistors, connected to the respective first terminals; a third plurality of directional circuit elements, such as diodes, connected to the second terminals; and a group of second switching elements connected to the directional circuit elements. The third element plurality is greater than the second plurality, and the number of second switching elements is smaller than the second plurality.

DESCRIPTION OF THE PREFERRED EMBODIMENTS

Figure 1:
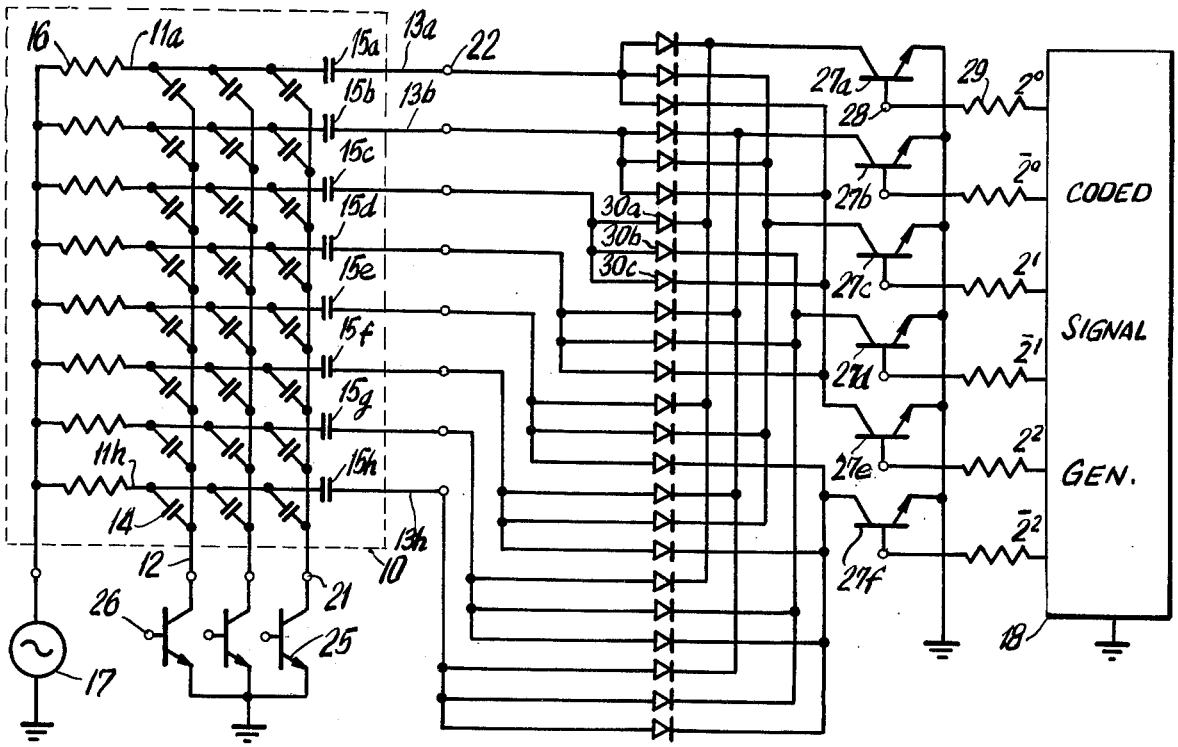
FIG. 1 schematically shows a driving circuit according to a first embodiment of the instant invention, together with a gas discharge panel, an electric power source, and a coded signal generator.

Referring to FIG. 1, a circuit according to a first embodiment of the present invention drives a gas discharge panel 10 comprising a set of first electrodes 11*a*, 11*b*, . . . , and 11*h*; a set of second electrodes 12 opposite to the first electrodes 11 (suffixes *a*, *b*, and so on being omitted where they would detract from the clarity of the drawing; third electrodes 13*a*, 13*b*, . . . , and 13*h* opposite and in one-to-one corresponding with the first electrodes 11. Only eight first electrodes 11 and three second electrodes 12 are depicted for simplicity of illustration.

Display cells 14 are defined between each of the second electrodes 12 and at least one of the first electrodes 11. Control cells 15*a*, 15*b*, 15*c*, 15*d*, 15*e*, 15*f*, 15*g*, and 15*h* are formed between the first electrodes 11 and the corresponding third electrodes 13. The display cells 14 have a substantially common discharge sustaining voltage that is higher than a substantially common firing voltage of the control cells 15.

The gas discharge panel 10 further comprises stabilizing resistors 16, one end of the resistor being connected to the respective first electrodes 11. Since the panel 10 is not a part of this invention, details thereof are not described herein, and the above-cited patent application may be referred to for such detail. The circuit drives the panel 10 in cooperation with an electric power source 17 having one terminal grounded and the other terminal connected to its other ends of the resistors 16, and a coded signal generator 18 described below. The resistors 16 need not be included within the composite panel 10 and may be connected between the first electrodes 11 of the panel 10 and the undergrounded terminal of the power source 17. The resistance of the resistors 16 is dependent upon the firing voltage of the control cells 15 and the source voltage of the power source 17, and is selected so that the voltage applied across the display cells 14 in the manner presently described is higher than the discharge sustaining voltage thereon and that the voltage applied across the control cells 15 is such as to prevent a gas discharge from spreading over the entire area of each control cell 15 as described in the above-referenced patent application.

Further referring to FIG. 1, the driving circuit includes a plurality of first terminals 21 for connection to the second electrodes 12, a plurality of second terminals 22 for connection to the third electrodes 13, a group of first NPN transistors 25 having emitter electrodes grounded and collector electrodes connected to the respective terminals 21, and first control terminals 26 connected to base electrodes of the respective first transistors 25 as described in the patent application referred to hereinabove. The first and second terminals 21 and 22 may not necessarily be in one-to-one correspondence to the second and third electrodes 12 and 13, respectively. The driving circuit further includes a group of second NPN transistors 27*a*, 27*b*, 27*c*, 27*d*, 27*e*, and 27*f* having emitter electrodes grounded and base electrodes connected to second control terminals 28, respectively, to which the coded signal generator 18 supplies obverse and reverse binary coded signals (i.e., a binary digit and its complement, or inverse) $2^0$, $2^{-1}$, $2^{-1}1$, $2^2$, and $2^{-2}$ through impedance elements 29, as described also in the referenced patent application.

least significant digit. Alternatively, the second transistors 27 may be divided into two subgroups, one for the obverse coded signals (i.e., a digit), and the other for the reverse ones (i.e., for the digit's complement, or inverse), each containing of three second transistors 27*a*, 27*c*, and 27*e* or 27*b*, 27*d*, and 27*f* in one-to-one correspondence to the diodes 30 connected to each second terminal 22. The diodes 30 connected to each second terminal 22 may be connected to the corresponding second transistors 27, one each from the respective subgroups.

TABLE

| Control Cells | | | | | | | | Second Transistors | | | | | |
|---|---|---|---|---|---|---|---|---|---|---|---|---|---|
| 15a | 15b | 15c | 15d | 15e | 15f | 15g | 15h | 27a | 27b | 27c | 27d | 27e | 27f |
| x | o | o | o | o | o | o | o | off | on | off | on | off | on |
| o | x | o | o | o | o | o | o | on | off | off | on | off | on |
| o | o | x | o | o | o | o | o | off | on | on | off | off | on |
| o | o | o | x | o | o | o | o | on | off | on | off | off | on |
| o | o | o | o | x | o | o | o | off | on | off | on | on | off |
| o | o | o | o | o | x | o | o | on | off | off | on | on | off |
| o | o | o | o | o | o | x | o | off | on | on | off | on | off |
| o | o | o | o | o | o | o | x | on | off | on | off | on | off |

According to this invention, collector electrodes of the second transistors 27 are not connected directly to the second terminals 22. In an example of the first embodiment depicted in FIG. 1, the driving circuit includes three diodes 30*a*, 30*b*, and 30*c* having anodes connected to each of the second terminals 22. The number "three" is selected in conformity with three that appears in the number of the second terminals 22 as two to the power three. The number of the diodes 30 is thus three times two to the power three. On the other hand, the number of the second transistors 27 is two times three. The second terminals 22 and transistors 27 therefore have a ($2^{3-1}$, 3) correspondence therebetween. That is, each of the second terminals 22 is associated with three of the second transistors 27 and each of the second transistors 27 is associated with two to the power three less one second terminals 22. Cathodes of the diodes 30 are connected to collector electrodes of the second transistors 27 to connect the second terminals 22 to the second transistors 27 in compliance with the correspondence. Viewed differently, the second transistors 27 are divided into three subgroups, each consisting of two of the second transistors 27*a* and 27*b*, 27*c* and 27*d*, or 27*e* and 27*f*. The diodes 30 connected to each of the second terminals 22 are thus in one-to-one correspondence with the subgroups of the second transistors 27 and connected to one of the second transistors of the corresponding subgroups 27*a*, 27*c*, and 27*e*; 27*b*, 27*c*, and 27*e*; 27*a*, 27*d*, and 27*e*; 27*a*, 27*c*, and 27*f*; 27*b*, 27*d*, and 27*e*; 27*a*, 27*d*, and 27*f*; 27*b*, 27*c*, and 27*f*; or 27*b*, 27*d*, and 27*f*.

Describing a specific example of the diode connection array illustrated in FIG. 1, the second transistors 27*a* and 27*b* of a first of the subgroups are connected to first ones of the diodes, such as 30*a*, connected to every other, namely, ever $2^0$, second terminal 22. The second transistors 27*c* and 27*d* of a second of the subgroups are connected to second ones of the diodes, such as 30*b*, connected to every two, namely, every $2^1$, second terminal 22. The second transistors 27*e* and 27*f* of a third of the subgroups are connected to third ones of the diodes, such as 30*c*, connected to every four, namely, every $2^2$, second terminal 22. The first through third subgroups of the second transistors 27 are supplied with signals of the first through third digits, respectively, of the binary codes as counted from the In operation of the specific example being considered, a gas discharge occurs in only one of the control cells 15, and at a time when the binary coded signals supplied to the second control terminal 28 render the second transistors 27 on and off as given in the above Table, where *o* and *x* represent firing and non-firing of the control cells 15. It is therefore possible to select only one of the control cells 15 at a time and to fire desired one or ones of the display cells 14 by supplying control signals to the first control terminals 26 to render the first transistors 25 associated with the desired display cell or cells 14 on and off in synchronism with the on-off states of the second transistors 27. It will be appreciated that the diodes 30 perform a decoding function and that the numbers of the second terminals 22, diodes 30, and second transistors 27 are $2^n$, $2^n n$, and $2n$ in accordance with the first embodiment, where $n$ represents a predetermined integer.

Figure 2:
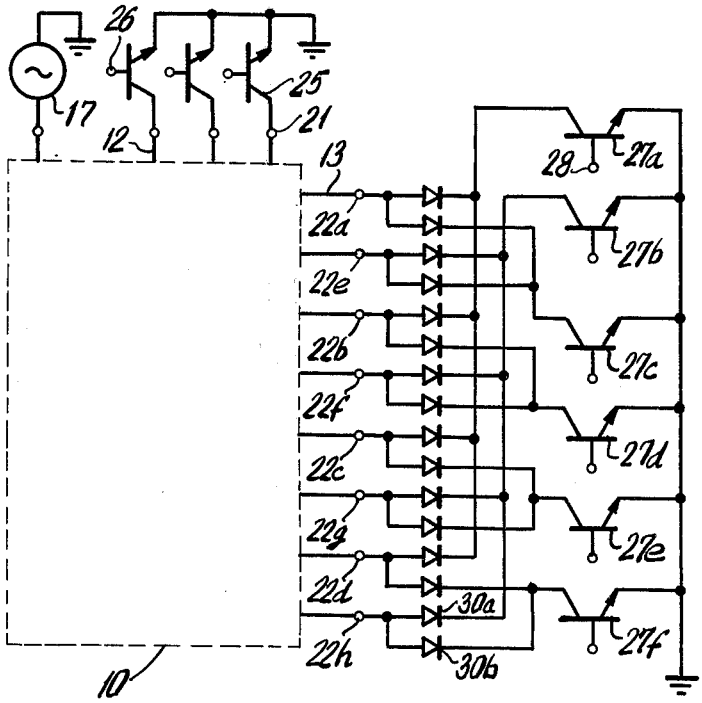
FIG. 2 similarly shows a driving circuit according to a second embodiment of this invention.

Referring to FIG. 2, a driving circuit according to a second embodiment of this invention is similar to that according to the first embodiment. The main difference between the first and second embodiments resides in the fact that the second embodiment comprises a first and a second diode 30*a* and 30*b*, only two in number, connected to each second terminal 22. For brevity of description, the number of the second terminals 22 is presumed to be $n$ times $m$, where $n$ and $m$ represent a first and a second integer. It is now possible to divide the second terminals 22 into the first number, $n$, of subsets, each consisting of the second number, $m$, of the second terminals 22. The second transistors 27, $n$ plus $m$ in number, are divided into a first and a second subgroup, consisting of the first and second numbers of the second transistors 27, respectively. The second transistors 27, $n$ in number, of the first subgroup are in one-to-one correspondence to the subsets of the second terminals 22. The second transistors 27, $m$ in number, of the second subgroup are in one-to-one correspondence to the second terminals 22 of each subset. The first diode, such as 30*a*, connected to the second terminals 22 of the respective subsets are connected to the corresponding second transistors 27 of the first subgroup. The second diodes, such as 30*b*, connected to the second terminals 22 of each subset are connected to the corresponding second transistors 27 of the second subgroup. Control signals supplied to the second control terminals 23 renders nonconductive only one transistors 27 in each of the first and second subgroups.

In a specific example illustrated in FIG. 2, the first and second numbers are two and four. The first subset of the second terminals 22 consists of second terminals 22*a*, 22*b*, 22*c*, and 22*d*, which are connected to a first of the second transistors 27*a* of the first subgroup through the first diodes, such as 30*a*. The second subset of the second terminals 22 consists of second terminals 22*e*, 22*f*, 22*g*, and 22*h*, which are connected to a second of the second transistors 27b of the first subgroup through the first diodes. The second terminals 22*a*, 22*b*, 22*c*, and 22*d* or 22*e*, 22*f*, 22*g*, and 22*h* of each subset are connected to a first through a fourth of the second transistors 27*c*, 27*d*, 27*e*, and 27*f* of the second subgroup through the second diodes, such as 30*b*.

Figure 3:
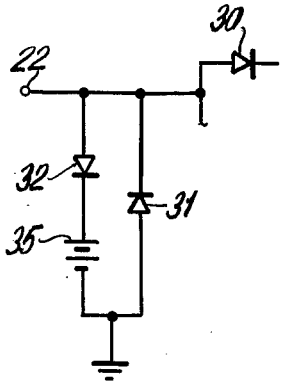
FIG. 3 is a circuit diagram of a clamping circuit for use in the embodiments of this invention.

Finally referring to FIG. 3, each of the second terminals 22 of a driving circuit for a gas discharge panel, such as 10, of an a.c. gas discharge type is preferably accompanied by a clamping circuit for obviating that undesirable high frequency voltage which would otherwise be induced on the third electrode 13 through a control cell 15 connected to the third electrode 13. The clamping circuit comprises a first diode 31 having an anode grounded and a cathode connected to the second terminal 22, a second diode 32 having an anode connected to the second terminal 22, and a clamping voltage source 35 connected between a cathode of the second diode 32 and ground. The voltage source 35 may be common to the clamping circuits associated with the respective second terminals 22. A like clamping circuit may be used for each of the first terminals 21 to protect the first transistor 25 connected thereto against a similar undesirable high frequency voltage.

While two preferred embodiments of this invention and specific examples thereof have thus far been described with reference to the accompanying drawing, it will readily be understood by those skilled in the art that the gas discharge panel to be driven by a driving circuit according to this invention may be either of a d.c. or of an a.c. gas discharge type.

The above described arrangement is merely illustrative of the principles of the present invention. Numerous modifications and adaptations thereof will be readily apparent to those skilled in the art without departing from the spirit and scope of the present invention.

What is claimed is:

1. A driving circuit for a gas discharge panel comprising a set of first electrodes, a set of second electrodes opposite to the first electrodes, third electrodes opposite and in one-to-one correspondence to the first electrodes, display cells between each of the second electrodes and at least one of the first electrodes, and control cells between the first electrodes and the corresponding third electrodes, said second and third electrodes disposed facing the same surface of said first electrodes, said crcuit comprising;

a plurality of first terminals connected to the second electrodes, a plurality of second terminals connected to the third electrodes, a group of first switching elements connected to said first terminals, a plurality of directional circuit elements connected to said second terminals, said directional circuit elements being greater in number than said second terminals, and a plurality of second switching elements connected to said directional circuit elements, the number of said second switching elements being smaller than the number of said second terminals wherein:

a predetermined number of said directional circuit elements are connected to each of said second terminals, and said second switching elements are divided into said predetermined number of subgroups, the directional circuit elements connected to each of said second terminals being connected to one of said second switching elements of the respective subgroups thereof.

2. A driving circuit as claimed in claim 1, further comprising signalling means connected to said second switching elements for selectively rendering the directional circuit elements connected to only one of said second terminals nonconductive at a time.

3. A driving circuit as claimed in claim 2, wherein:

said second terminals are two to the power $n$ in number, where $n$ represents said predetermined number, $n$ directional circuit elements are connected to each of said second terminals, each of a first through an $n$-th one of said subgroups consists of two of the second switching elements, said first through $n$-th directional circuit elements connected to each of said second terminals being thereby in one-to-one correspondence to said first through $n$-th subgroups and connected to one of the second switching elements of the corresponding subgroups, and said signalling means comprises:

means for producing obverse and reverse binary coded signals of a first through a $n$-th digit which are in one-to-one correspondence to said first through $n$-th subgroups, and means for supplying said obverse and reverse binary coded signals to second switching elements of corresponding subgroups.

4. A driving circuit as claimed in claim 3, wherein the second switching elements of a $i$-th subgroup, where $i$ represents an integer between one and $n$, inclusive, are connected to the $i$-th directional circuit elements connected to every $2^i$ of said second terminal

5. A driving circuit as claimed in claim 2, wherein:

said second terminals are divided into a first number of subsets, each of said subsets consisting of a second number of said second terminals, a first and a second one of said directional circuit elements are connected to each of said second terminals, said predetermined number being two, a first of said subgroups consists of said first number of said second switching elements, the second switching elements of said first subgroup thereby being in one-to-one correspondence to said subsets of the second terminals, the first directional circuit elements connected to the second terminals of the respective subsets being connected to the corresponding second switching elements of said first subgroup, a second of said subgroups consists of said second number of the second switching elements, the second switching elements of said second subgroup thereby being in one-to-one correspondence to the second terminals of each subset, the second directional circuit elements connected to the second terminals of each subset being connected to the corresponding second switching elements of said second subgroup, and said signalling means comprises means connected to said second switching elements for rendering only one of the second switching elements of the respective subgroups nonconductive at a time.

6. A driving circuit for a gas discharge panel comprising a set of first, second and third electrodes, display cells between said second electrodes and at least one of said first electrodes, and control cells between said first and third electrodes, said first electrodes being associated with plural of said second electrodes and one of said third electrodes, said circuit comprising:

a plurality of controlled switching elements fewer in number than said third electrodes, signalling means for supplying selection controlling signals to said controlled switching elements, and a diode array interconnecting said third electrodes and said controlled switching elements.

7. A combination as in claim 6 wherein said controlled switching elements are divided into subgroups, and wherein said diode array interconnects each of said third electrodes with a controlled switching element in each subgroup.

* * * * *